US010451244B2

(12) United States Patent
Berrezai et al.

(10) Patent No.: US 10,451,244 B2
(45) Date of Patent: Oct. 22, 2019

(54) COOLING AIR DUCT FOR MOTOR VEHICLE HEADLAMP

(71) Applicant: Valeo Vision, Bobigny (FR)

(72) Inventors: Francois Berrezai, Clichy (FR); Lotfi Redjem-Saad, Paris (FR)

(73) Assignee: Valeo Vision, Bobigny (FR)

( * ) Notice: Subject to any disclaimer, the term of this patent is extended or adjusted under 35 U.S.C. 154(b) by 219 days.

(21) Appl. No.: 15/279,533

(22) Filed: Sep. 29, 2016

(65) Prior Publication Data

US 2017/0102120 A1 Apr. 13, 2017

(30) Foreign Application Priority Data

Oct. 9, 2015 (FR) ..... 15 59625

(51) Int. Cl.
*F21S 45/43* (2018.01)
*F21S 45/49* (2018.01)

(52) U.S. Cl.
CPC ..... *F21S 45/43* (2018.01); *F21S 45/49* (2018.01)

(58) Field of Classification Search
CPC ..... F21S 48/325; F21S 48/10; F21S 48/321; F21S 45/43; F21S 45/49; F21S 45/47; F21S 45/40; F21S 45/33; F21S 45/37; F21S 45/30; F21S 45/42; F21V 29/00; F21V 29/50; F21V 29/502; F21V 29/503; F21V 29/60; F21V 29/67; F21V 29/673; F21V 29/677
USPC ..... 362/543
See application file for complete search history.

(56) References Cited

U.S. PATENT DOCUMENTS

| | | | | |
|---|---|---|---|---|
| 8,337,063 | B2 | 12/2012 | Nagasawa et al. | |
| 8,911,125 | B2 | 12/2014 | Suzuki et al. | |
| 2007/0091632 | A1* | 4/2007 | Glovatsky | B60Q 1/0052 362/547 |
| 2007/0127257 | A1* | 6/2007 | Erion | F21S 41/147 362/547 |
| 2011/0051453 | A1 | 3/2011 | Nagasawa et al. | |
| 2013/0201706 | A1 | 8/2013 | Suzuki et al. | |
| 2016/0084471 | A1* | 3/2016 | Sander | F21S 45/43 362/547 |
| 2016/0208997 | A1* | 7/2016 | Silvi | F21S 48/325 |

FOREIGN PATENT DOCUMENTS

| | | | |
|---|---|---|---|
| DE | 102007043961 | A1 | 3/2009 |
| DE | 102013217597 | A1 | 3/2015 |
| EP | 2623851 | A1 | 8/2013 |
| FR | 2946730 | A1 | 12/2010 |
| WO | 2005116522 | A1 | 12/2005 |

* cited by examiner

*Primary Examiner* — Bao Q Truong
(74) *Attorney, Agent, or Firm* — Oblon, McClelland, Maier & Neustadt, L.L.P.

(57) ABSTRACT

A headlamp, notably for a motor vehicle, comprising several light modules and an air cooling duct for the light modules with at least one air inlet for one or more fans, several air outlets to the light modules, and a passage connecting the one or more inlets with the outlets. The duct comprises at least one attached separating wall of the passage.

20 Claims, 4 Drawing Sheets

COOLING AIR DUCT FOR MOTOR VEHICLE HEADLAMP

CROSS-REFERENCE TO RELATED APPLICATIONS

This application claims priority to the French application 1559625, filed Oct. 9, 2015, which application is incorporated herein by reference and made a part hereof.

BACKGROUND OF THE INVENTION

1. Field of the Invention

The invention a relates to the field of lighting and/or light indicators, notably for a motor vehicle. More particularly, the invention relates to the cooling of light modules of a motor vehicle headlamp.

2. Description of the Related Art

The light sources present in the headlamps and lighting devices are subject to overheating and often need to be cooled. This is particularly the case for semiconductor light sources, such as light-emitting diodes or laser diodes. These light sources are indeed very small in size while offering significant lighting power. They are usually disposed on a printed circuit type board and are often thermally coupled to one or more radiators.

The published patent document DE 10 2007 043 961 A1 discloses a headlamp comprising a plurality of light modules whose light sources of the semiconductor type are coupled to radiators. These radiators are cooled by a stream of air forced through a duct. This duct comprises a cooling air inlet set into motion by a fan, a plurality of outlets opening near coolers and an air passage connecting the inlet to the outlets. The passage comprises branches dividing the air flow of the inlet into several flows toward the various outlets. The construction of the duct is conventional in that it is the branches of the duct that distribute the inlet air flow. The number of possible outlets is limited, however, by the branches and, also, by the distribution of the specific flows from the various outputs is not controlled. An unidentified pressure loss downstream in one of the branches can have a significant adverse effect on flow distribution. Furthermore, the creation of branches is not without certain congestion and production cost problems.

Similarly to the previous document, patent document FR 2 946 730 A1 discloses a motor vehicle headlamp, comprising a plurality of modules whose light sources are cooled by a flow of cooling air circulating through a duct disposed between a fan and respective radiators of the light sources. Similarly to the duct of the previous teaching, the duct is bulky and complex in shape from a production cost point of view. The flow distribution presents the same drawbacks as in the previous teaching.

Patent document US 2011/0051453 A1, now issued as U.S. Pat. No. 8,337,063, discloses a motor vehicle headlamp, including several light modules whose light sources are in thermal contact with a common radiator. A fan is disposed in the low position and at a distance from the radiator to allow the light sources and the radiator to pivot in relation to a directional lighting function. This solution is interesting in its simplicity but has constraints regarding the location of the modules and more particularly the light sources.

SUMMARY OF THE INVENTION

The invention aims to propose a solution to the problem of cooling light modules of a headlamp or lighting device.

More particularly, the invention aims to enable efficient distribution of a cooling air flow produced by one or more radiators.

The invention relates to a headlamp, particularly for a motor vehicle, comprising: a plurality of light modules; a cooling air duct for light modules, with at least one air flow inlet from one or more fans, a plurality of air outlets to the light modules, and a passage connecting the one or more inlets with the outlets; remarkable in that the duct comprises at least one attached separating wall of the passage.

The term 'attached wall' refers to a distinct wall of the body of the duct, the wall being secured to the body. The body advantageously forms the outer walls of the duct.

The passage advantageously forms several fluid streams, such as at least four fluid streams, for example. Each fluid stream is advantageously associated with one or more outlets.

The duct is advantageously made of plastic material, particularly thermoplastic.

According to an advantageous embodiment of the invention, the at least one of the attached walls is adjacent to the inlet or at least one of the inlets.

According to an advantageous embodiment of the invention, the duct generally extends in a plane, the at least one of the attached walls being parallel to the plane or forming an angle of less than 15°, preferably of less than 10°, with the plane.

According to an advantageous embodiment of the invention, the at least one of the attached walls is configured to divide the air flow, preferably at the inlet of the duct, into at least two separate streams in the direction of the various outlets.

According to an advantageous embodiment of the invention, the one or more attached walls cooperate with one or more fixed separating walls so as to divide the air flow, preferably at the inlet of the duct, into at least four separate streams toward the various outlets.

According to an advantageous embodiment of the invention, the one or more fixed separating walls are transversal, preferably perpendicular, to the one or more attached walls.

According to an advantageous embodiment of the invention, the duct comprises at least two hollow parts assembled to one other, the at least one of the attached walls being disposed between the hollow parts. The one or more attached walls are thus sandwiched between the at least two hollow parts.

According to an advantageous embodiment of the invention, the at least two hollow parts define in a complementary manner the passage between the one or more inlets and the outlets, according to one or more transversal sections of the passage.

According to an advantageous embodiment of the invention, the at least two hollow parts form at least one hinge connecting them and enabling them to come closer together for the purpose of assembly, the hinge preferably being integrally formed with the at least two hollow parts.

According to an advantageous embodiment of the invention, the at least two members are assembled along a generally planar mutual contact surface, the at least one of the attached walls extending parallel to the plane or forming an angle with the plane of less than 15°, preferably less than 10°.

According to an advantageous embodiment of the invention, the at least two hollow parts define the inlet or at least one of the inlets, along a transversal cross section of the one or more inlets.

According to an advantageous embodiment of the invention, each of the outlets is integrally formed on one of the at least two hollow parts.

According to an advantageous embodiment of the invention, at least one, preferentially each, of the outlets form a channel extending transversely to the duct.

According to an advantageous embodiment of the invention, the channel formed by the one or more outlets have a cross section with a converging profile.

According to an advantageous embodiment of the invention, each of the at least two hollow parts comprises a back wall, each of the fixed separating walls extending onto one of the back walls.

According to an advantageous embodiment of the invention, each of the at least two hollow parts comprises lateral walls, each of the fixed separating walls being in contact with at least one of the lateral walls.

According to an advantageous embodiment of the invention, the fixed separating walls comprise at least one partitioning wall transversal to the duct, with an edge adjacent to an edge of one of the attached walls, the one or more partitioning walls preferably being generally straight.

According to an advantageous embodiment of the invention, the fixed separating walls comprise at least one guide wall extending along the duct, the one or more guide walls preferably being curved.

According to an advantageous embodiment of the invention, one or more partitioning walls are on one of the at least two hollow parts of the duct and at least one of the guide walls is on another of the at least two hollow parts.

The measures of the invention are interesting in that they allow a duct to be produced forming several streams to various outlets, which is highly efficient and economic. The duct is highly efficient in that providing at least one separating wall which is attached allows for optimal separation of the fluid streams. The duct is economical to produce in that all its fixed walls may extend in the same direction, which is favorable to the mold release operations. The one or more attached walls can thus cooperate with the fixed walls to define the various fluid streams to the various outlets in a precise and controlled manner.

These and other objects and advantages of the invention will be apparent from the following description, the accompanying drawings and the appended claims.

BRIEF DESCRIPTION OF THE ACCOMPANYING DRAWINGS

Other characteristics and advantages of the present invention will become more apparent from the description and the drawings, among which:

DETAILED DESCRIPTION OF THE PREFERRED EMBODIMENTS

Figure 1:
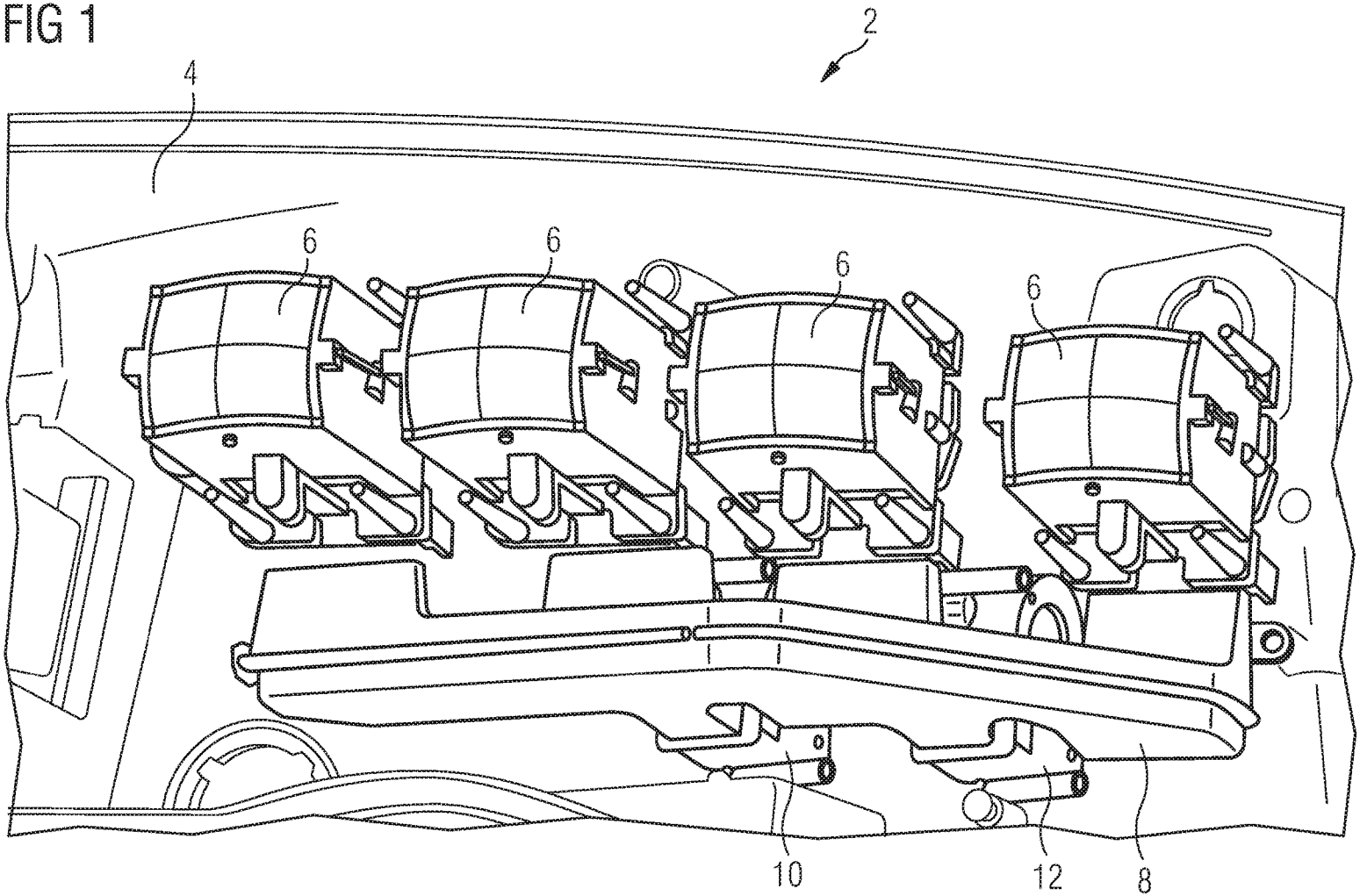
FIG. 1 is a front view of a headlamp according to a first embodiment of the invention.
Figure 2:
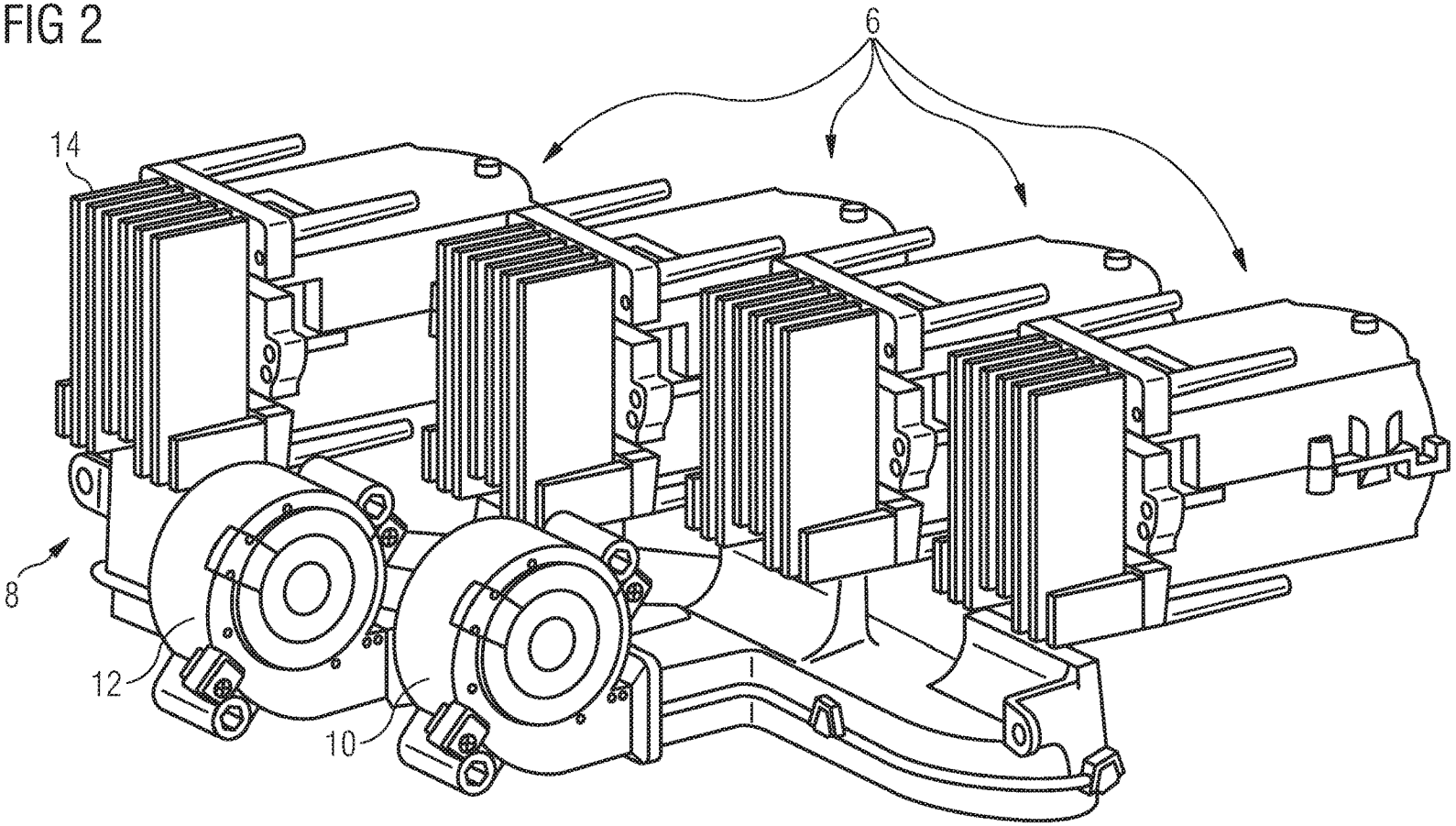
FIG. 2 is a rear view of the modules and of the cooling duct of the modules of the headlamp in FIG. 1.
Figure 3:
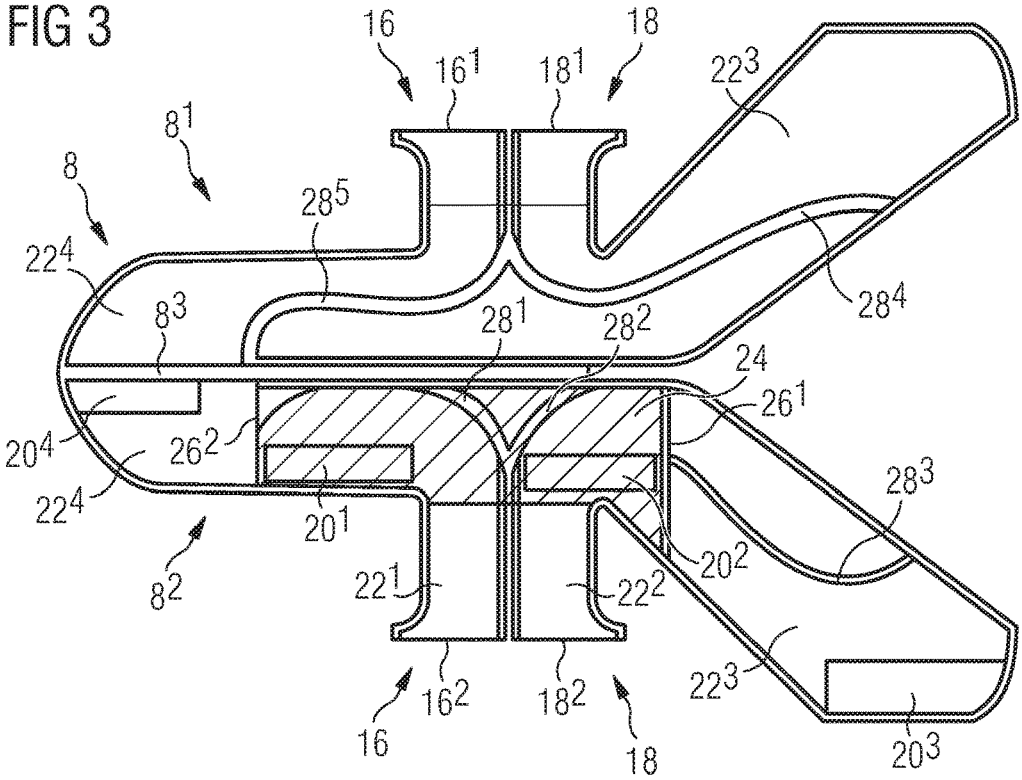
FIG. 3 is a plan view of the duct of FIGS. 1 and 2, the duct being in the open position.

FIGS. 1 to 3 illustrate a headlamp according to a first embodiment of the invention.

FIG. 1 illustrates a headlamp 2 from a viewpoint located at the front. The headlamp 2 is illustrated without an outer lens. It comprises a housing 4 accommodating light modules 6, in this case four lighting modules. The housing 4 also accommodates a cooling system for the light modules 6, more specifically for the light sources of the light modules 6 in question, comprising an air cooling duct 8 and two fans 10 and 12 aeraulically connected with the air cooling duct 8. This air cooling duct 8 comprises air outlets disposed near radiators of the light modules 6.

FIG. 2 is a rear view of the light modules 6 and their cooling system. One can observe the two fans 10 and 12 disposed in front of the corresponding inlets of the air cooling duct 8. One can also observe that the light modules 6 each comprise a radiator 14 disposed at the rear. The one or more light sources of each of the light modules 6 are thermally connected to the radiator 14, so that the cooling air flow of the air cooling duct 8, along the radiators 14, provides cooling for the one or more light sources in question.

The light sources are advantageously of the semiconductor type, such as light-emitting or laser type diodes.

FIG. 3 is a plan view of the air cooling duct 8, the latter consisting of two hollow parts $\mathbf{8}^1$ and $\mathbf{8}^2$ which are shown in the open state. More precisely, these two hollow parts $\mathbf{8}^1$ and $\mathbf{8}^2$ are interconnected by a hinge $\mathbf{8}^3$. The hollow parts $\mathbf{8}^1$ and $\mathbf{8}^2$ and the hinge $\mathbf{8}^3$ are advantageously made in one piece of plastic material.

Each of the two hollow parts $\mathbf{8}^1$ and $\mathbf{8}^2$ comprises two inlets $\mathbf{16}^1$, $\mathbf{16}^2$ and $\mathbf{18}^1$, $\mathbf{18}^2$. It is understood that the inlets $\mathbf{16}^1$ and $\mathbf{16}^2$, and the inlets $\mathbf{18}^1$ and $\mathbf{18}^2$, cooperate with one another when the two hollow parts $\mathbf{8}^1$ and $\mathbf{8}^2$ are assembled together to form inlets 16 and 18 of air cooling duct 8 cooperating with the fans 10 and 12 (FIG. 2), respectively.

The hollow part $\mathbf{8}^2$ comprises the four outlets $\mathbf{20}^1$, $\mathbf{20}^2$, $\mathbf{20}^3$ and $\mathbf{20}^4$ intended to be disposed near radiators 14 of the light modules 6 (FIG. 2). The air cooling duct 8 thus forms a passage connecting the inlets 16 and 18 to the outlets $\mathbf{20}^1$, $\mathbf{20}^2$, $\mathbf{20}^3$ and $\mathbf{20}^4$. More precisely, the passage is divided into four streams $\mathbf{22}^1$, $\mathbf{22}^2$, $\mathbf{22}^3$ and $\mathbf{22}^4$ specific to the four outlets $\mathbf{20}^1$, $\mathbf{20}^2$, $\mathbf{20}^3$ and $\mathbf{20}^4$, respectively. The stream $\mathbf{22}^1$ connects the inlet 16 ($\mathbf{16}^1$+$\mathbf{16}^2$) to the outlet $\mathbf{20}^1$. Similarly, the stream $\mathbf{22}^2$ connects the inlet 18 ($\mathbf{18}^1$+$\mathbf{18}^2$) to the outlet $\mathbf{20}^2$. The stream $\mathbf{22}^3$ connects the inlet 18 to the outlet $\mathbf{20}^3$ and the stream $\mathbf{22}^4$ connects the inlet 16 to the outlet $\mathbf{20}^4$. Each of the inlets 16 and 18 are thus connected to two streams $\mathbf{22}^1$ and $\mathbf{22}^4$, and $\mathbf{22}^2$ and $\mathbf{22}^3$, respectively. To do this, the air cooling duct 8 comprises a separating wall 24 (hatched area) disposed near the inlets 16 and 18 and substantially in the contact plane of the two hollow parts $\mathbf{8}^1$ and $\mathbf{8}^2$. This separating wall 24 is attached in that it is disposed between two hollow parts $\mathbf{8}^1$ and $\mathbf{8}^2$, this separating wall 24 being separate from the hollow parts $\mathbf{8}^1$ and $\mathbf{8}^2$. The attached separating wall 24 thus allows each of the two forced air flows to be divided in the inlets 16 and 18 by the fans 10, 12 into two fluid streams, in this case the fluid streams $\mathbf{22}^1$ and $\mathbf{22}^4$ for the inlet 16 and the fluid streams $\mathbf{22}^2$ and $\mathbf{22}^3$ for the inlet 18.

The fluid streams $\mathbf{22}^1$, $\mathbf{22}^2$, $\mathbf{22}^3$ and $\mathbf{22}^4$ are defined by means of the fixed separating walls $\mathbf{26}^1$, $\mathbf{26}^2$, $\mathbf{28}^1$, $\mathbf{28}^2$, $\mathbf{28}^3$, $\mathbf{28}^4$ and $\mathbf{28}^5$ of the two hollow parts $\mathbf{8}^1$ and $\mathbf{8}^2$. These fixed separating walls $\mathbf{26}^1$, $\mathbf{26}^2$, $\mathbf{28}^1$, $\mathbf{28}^2$, $\mathbf{28}^3$, $\mathbf{28}^4$ and $\mathbf{28}^5$ generally extend perpendicularly to the mean plane of contact of the two hollow parts $\mathbf{8}^1$ and $\mathbf{8}^2$ and, parting, from the attached separating wall 24. The attached separating wall 24 cooperates with the two separating walls $\mathbf{26}^1$ and $\mathbf{26}^2$ to define, in the hollow part $\mathbf{8}^2$, the streams $\mathbf{22}^1$ and $\mathbf{22}^2$. The free edges of the two separating walls 26$^1$ and 26$^2$ are adjacent to two opposite edges of the attached separating wall 24, respectively. Of the two other edges of the attached separating wall 24, one is adjacent to a lateral wall of the hollow part 8$^2$, along the hinge 8$^3$, and the other is located in the inlets 16 and 18 and forms a separating edge of the flows of these inlets 16 and 18.

The hollow parts 8$^1$ and 8$^2$ each include a back wall and lateral walls, the walls forming a U-profile. The fixed separating walls 26$^1$, 26$^2$, 28$^1$, 28$^2$, 28$^3$, 28$^4$ and 28$^5$ extend over the back walls and are in contact with the corresponding lateral walls.

Among the fixed separating walls 26$^1$, 26$^2$, 28$^1$, 28$^2$, 28$^3$, 28$^4$ and 28$^5$, the walls 28$^1$ and 28$^2$ are included on the hollow part 8$^2$, of generally curved shape and ensuring appropriate guidance of the fluid streams 22$^1$ and 22$^2$ toward outlets 20$^1$ and 20$^2$, respectively. The fixed separating wall 28$^3$ is also included, also on the hollow part 8$^2$, of generally curved shape and ensuring appropriate guidance of the fluid stream 22$^3$ toward the outlet 20$^3$. The fluid stream 22$^3$ extends, downstream from the attached separating wall 24, on the entire thickness of the air cooling duct 8, i.e. in the two hollow parts 8$^1$ and 8$^2$. For this purpose, the fixed separating wall 28$^4$ on the hollow part 8$^1$ cooperates with the fixed separating wall 28$^3$. It should be noted that the fixed separating wall 28$^4$ also cooperates with the attached separating wall 24 in that it comes into contact therewith. Similarly the fixed separating wall 28$^5$ on the hollow portion 8$^1$ also cooperates with the attached separating wall 24. Similarly to the fluid stream 22$^3$, the fluid stream 22$^4$ extends over the entire thickness of the air cooling duct 8 downstream from the attached separating wall 24.

When both hollow parts 8$^1$ and 8$^2$ are folded onto one another to form the air cooling duct 8, each of the inlets 16 and 18 has a portion of the separating edge of the attached separating wall 24, these edge portions separating into two each of the flows at the inlets 16 and 18. In other words, each of the flows produced by the fans 10 and 12 (FIGS. 1 and 2) is separated into two fluid streams near the inlets 16 and 18, which ensures controlled distribution of the flow toward the various outlets 20$^1$, 20$^2$, 20$^3$ and 20$^4$. Furthermore, placement of the attached separating wall 24 is particularly simple. Producing the hollow parts 8$^1$ and 8$^2$ is also advantageous in that they can be made in one piece by plastic injection molding. The walls defining the air cooling duct 8 and the fixed separating walls 26$^1$, 26$^2$, 28$^1$, 28$^2$, 28$^3$, 28$^4$ and 28$^5$ essentially extend all in the same direction, which is favorable to the mold release operations.

The attached separating wall 24 can be bonded or simply placed in an accommodation in the hollow part 8$^2$. The two hollow parts 8$^1$ and 8$^2$ can be assembled together by clipping, bonding and/or screws.

Figure 4:
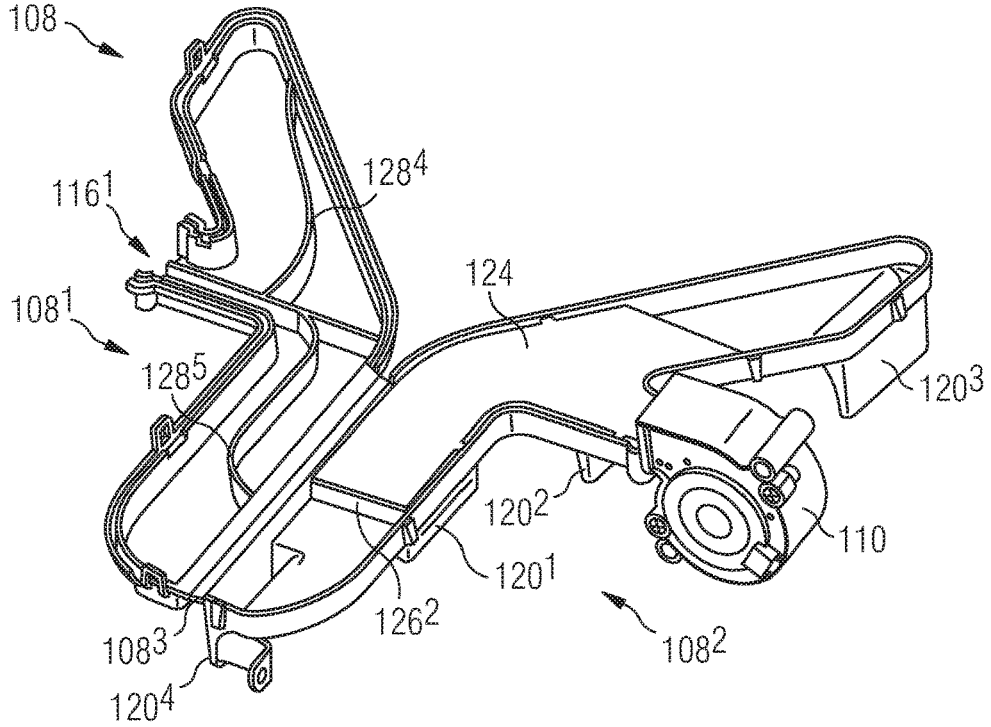
FIG. 4 is a perspective view of a duct according to a second embodiment, the duct being in the open position.
Figure 5:
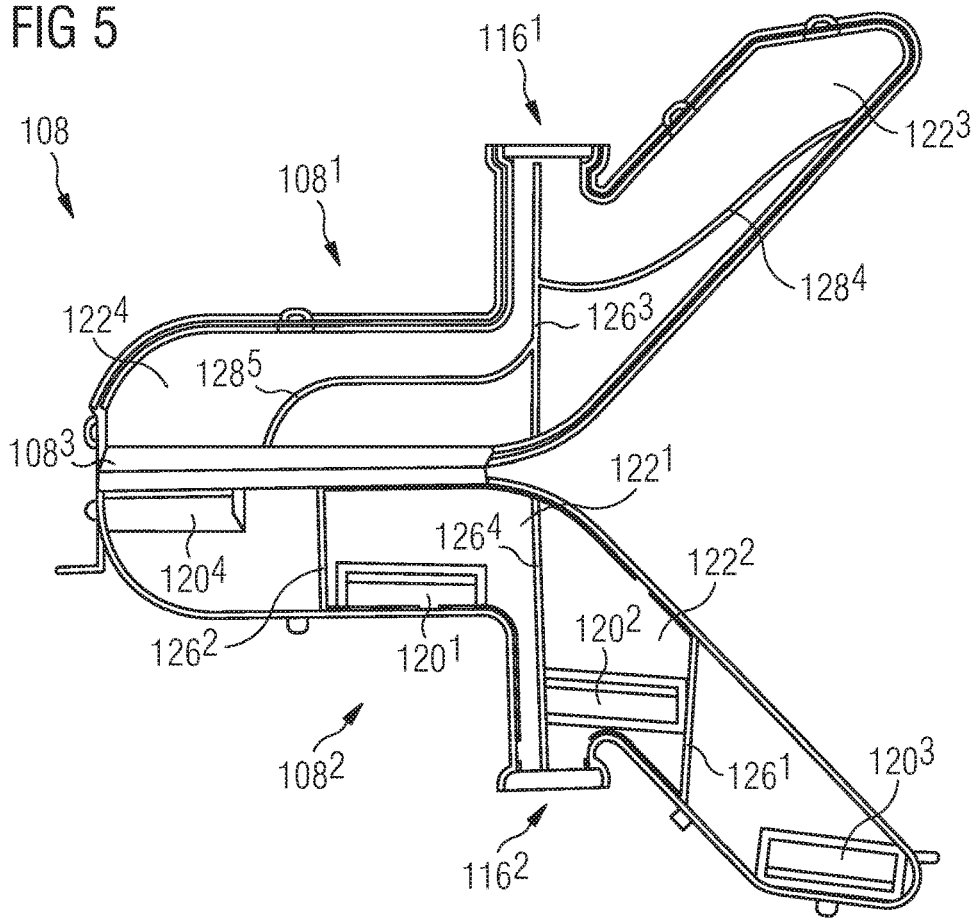
FIG. 5 is a plan view of the duct of FIG. 4.
Figure 6:
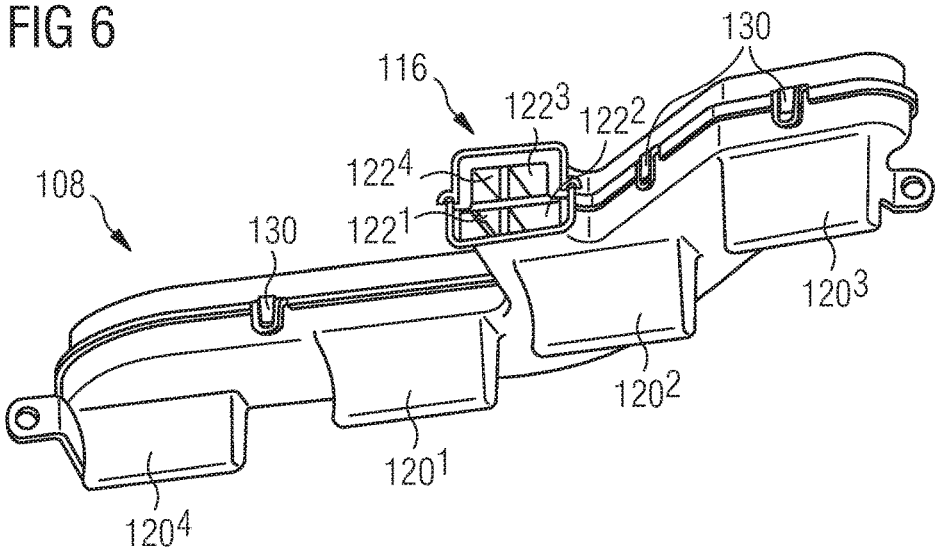
FIG. 6 is a perspective view of the duct of FIGS. 4 and 5, in the assembled state.

FIGS. 4 to 6 illustrate an air cooling duct 108 according to a second embodiment, provided that this air cooling duct 108 can be implemented in a headlamp as shown in FIG. 1.

The reference numbers of the first embodiment are used to designate the same elements or corresponding elements, although these numbers are increased by 100 in order to distinguish the two embodiments. Reference is also made to the description of these elements in relation with the first embodiment. Specific numbers are used for elements specific to this embodiment.

The air cooling duct 108 consists, similarly to that of the first embodiment, essentially of two hollow parts 108$^1$ and 108$^2$ interconnected by a hinge 108$^3$.

Unlike the air cooling duct 8 of FIGS. 1 to 3, the air cooling duct 108 has a single inlet 116 (116$^1$+116$^2$) for a single fan 110. This means that the air flow at the inlet 116 is divided into four fluid streams 122$^1$, 122$^2$, 122$^3$ and 122$^4$ toward various outlets 120$^1$, 120$^2$, 120$^3$ and 120$^4$, respectively. Each of the hollow parts 108$^1$ and 108$^2$ comprises a fixed separating wall 126$^3$ and 126$^4$, respectively, extending in the axis of the inlet 116. These two walls 126$^3$ and 126$^4$ are advantageously aligned, provided, however, that they can also be shifted. The attached separating wall 124 extends transversely to the walls 126$^1$, 126$^2$, 126$^3$ and 126$^4$. The walls 126$^1$, 126$^2$ and 126$^4$ define, with the attached separating wall 124, the streams 122$^1$ and 122$^2$ in the hollow part 108$^2$. Similarly, the walls 126$^3$, 128$^4$ and 128$^5$ define, with the attached separating wall 124, the streams 122$^3$ and 122$^4$ in the hollow part 108$^1$, up to the attached separating wall 124, and in the hollow parts 108$^1$ and 108$^2$, downstream of the separating wall 124.

In the FIG. 6, one can observe the clipping means 130 ensuring the connection between the two hollow parts 108$^1$ and 108$^2$ so that they are fastened together.

In relation with the two embodiments above and generally speaking, the outlets 120$^1$, 120$^2$, 120$^3$ and 120$^4$ of the air cooling duct 108 can form channels extending transversely over the overall extent of the air cooling duct 108. These channels may have a converging cross section designed to accelerate the flow of cooling air.

Generally speaking, it is understood that the number of inlets, outlets and fluid streams can vary from the two embodiments described above.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A headlamp for a motor vehicle, comprising:

a plurality of light modules, each light module including a corresponding radiator; and an air cooling duct for said plurality of light modules that includes at least one inlet for air flow from one or more fans, at least one air outlet corresponding to each of the radiators of the light modules, a passage connecting said at least one inlet with said at least one air outlet, at least one fixed separating wall, and at least one attached separating wall of the passage, wherein the at least one attached separating wall is adjacent to a free edge of the at least one fixed separating wall, and wherein the air cooling duct is disposed below the plurality of light modules in a direction perpendicular to an optical axis of the light modules.

2. The headlamp according to claim 1, wherein said at least one attached separating wall is adjacent to said at least one inlet.

3. The headlamp according to claim 1, wherein said air cooling duct extends in a plane, said at least one attached separating wall being parallel to said plane or forming an angle 15° with said plane.

4. The headlamp according to claim 1, wherein said at least one attached separating wall is configured to divide the air flow into at least two separate streams toward said at least one air outlet.

5. The headlamp according to claim 1, wherein said at least one attached separating wall cooperates with the at least one fixed separating walls and divide the air flow at said at least one inlet of said air cooling duct, into at least four separate streams toward said at least one air outlet.

6. The headlamp according to claim 5, wherein the at least one fixed separating walls are transversal to the at least one attached separating wall.

7. The headlamp according to claim 5, wherein said air cooling duct includes at least two hollow parts assembled together, said at least one attached separating wall being disposed between said at least two hollow parts.

8. The headlamp according to claim 7, wherein said at least two hollow parts form at least one hinge connecting the at least two hollow parts and enabling the at least two hollow parts to come closer together for assembly, said at least one hinge being integrally formed with said at least two hollow parts.

9. The headlamp according to claim 7, wherein said at least two hollow parts are assembled along a planar mutual contact surface, said at least one attached separating wall extending parallel to said planar mutual contact surface or forming an angle with said planar mutual contact surface of less than 15°.

10. The headlamp according to claim 7, wherein said at least two hollow parts define said at least one inlet, along a transversal cross section of said at least one inlet.

11. The headlamp according to claim 7, wherein each of said at least one air outlet is integrally formed on one of said at least two hollow parts.

12. The headlamp according to claim 7, wherein at least one of said at least one air outlet forms a channel extending transversely to said air cooling duct.

13. The headlamp according to claim 12, wherein said channel formed by said at least one air outlet has a cross section with a convergent profile.

14. The headlamp according to claim 7, wherein each of said at least two hollow parts includes a back wall, the at least one fixed separating walls extending onto one of said back walls.

15. The headlamp according to claim 14, wherein each of said at least two hollow parts includes lateral walls, the at least one fixed separating walls being in contact with at least one of said lateral walls.

16. The headlamp according to claim 14, wherein the at least one fixed separating walls include at least one partitioning wall transversal to said air cooling duct, with an edge adjacent to an edge of said at least one attached separating wall, said at least one partitioning wall being straight.

17. The headlamp according to claim 16, wherein the at least one fixed separating walls include at least one guide wall extending along said air cooling duct, said at least one guide wall being curved.

18. The headlamp according to claim 17, wherein said at least one partitioning wall is on one of said at least two hollow parts of said air cooling duct and said at least one guide wall is on another of said at least two hollow parts.

19. The headlamp according to claim 1, wherein said air cooling duct extends in a plane, said at least one attached separating wall being parallel to said plane or forming an angle of less than 10° with said plane.

20. The headlamp according to claim 15, wherein a first end of the at least one attached separating wall is adjacent to the lateral walls of the hollow part along the hinge, and a second end of the at least one attached separating wall opposite of the first end is located at the at least one inlet.

* * * * *